United States Patent [19]

Marshall et al.

[11] 3,954,631

[45] May 4, 1976

[54] SPIN FINISH FOR TEXTURED CARPET YARN

[75] Inventors: Robert Moore Marshall, Chester; John Irving Scott, Richmond, both of Va.

[73] Assignee: Allied Chemical Corporation, Petersburg, Va.

[22] Filed: Aug. 9, 1974

[21] Appl. No.: 495,950

[52] U.S. Cl. ..... 252/8.7; 28/72.12; 28/75 WT; 252/8.9

[51] Int. Cl.[2] ..... D06M 13/30

[58] Field of Search ..... 252/8.7, 8.6, 8.8, 8.9; 28/72.12, 75 WT

[56] References Cited

UNITED STATES PATENTS

| | | | |
|---|---|---|---|
| 3,306,850 | 2/1967 | Olsen | 252/8.7 |
| 3,649,535 | 3/1972 | Clark | 252/8.75 |
| 3,781,202 | 12/1973 | Marshall et al. | 252/8.7 |

OTHER PUBLICATIONS

Proctor Chem. Co., Product List, Vol. 4.

Emery Industries Inc., Spec. for Emerest 2440, Corn Oil Glyceride.

Humble Oil & Ref. Co. Data Sheet on "Natural Petroleum Sulfonates."

Chem. Abs., 74P:142956*t*, (1971).

*Primary Examiner*—Murray Tillman
*Assistant Examiner*—T. DeBenedictis, Sr.
*Attorney, Agent, or Firm*—Richard A. Anderson

[57] ABSTRACT

A spin finish composition for nylon feeder yarn to be processed at high temperature into carpet yarn, such as by steam jet texturing, comprising tridecyl stearate with a specific emulsifier and an antistatic agent results in improved processing and better quality yarn, and yarn packages.

2 Claims, No Drawings

SPIN FINISH FOR TEXTURED CARPET YARN

BACKGROUND OF THE INVENTION

This invention relates to a yarn finish. More specifically, this invention relates to a spin finish for polyamide feeder yarn to be processed at high temperature into carpet yarn such as by steam jet texturing.

Various finishes for synthetic filaments are disclosed in the prior art for high temperature processing. However, none of the prior art teach a specific combination of ingredients to achieve the specific beneficial results of the composition of this invention. The critical amounts and ingredients are shown in the discussion below. Many of the prior art finishes flash off in high temperature processing such as steam jet texturing for yarn. Others fail to have emulsion stability or have insufficient yarn lubrication. Still others require numerous, costly components, and do not provide good package formation during take-up of the yarn, or good package unwinding properties.

The yarn finish of this invention is an improvement over the finish disclosed in U.S. Pat. No. 3,781,202 which is hereby specifically incorporated by reference in toto. The esters resulting from the reaction of a long chain fatty acid with a monohydric long chain aliphatic alcohol are known as textile yarn lubricants in U.S. Pat. No. 3,306,850 and U.S. Pat. No. 3,649,535. However, for high temperatures, diesters are taught, or other lubricants must be added.

SUMMARY OF THE INVENTION

The composition of the oil portion of yarn spin finish of this invention is

I

| Component | Percent by Weight |
|---|---|
| a) tridecyl stearate | 40 to 60 |
| b) corn oil glyceride ethoxylated with 10 mols ethylene oxide | 20 to 30 |
| c) sulfated glycerol trioleate | 20 to 30 |

or

II

| | |
|---|---|
| a) tridecyl stearate | 40 to 60 |
| b) polyethylene glycol (10) oleate | 20 to 30 |
| c) sulfonated petroleum product | 20 to 30 |

The compound labeled b) is an emulsifier. The compound labeled c) is an antistatic compound.

The yarn finish composition has all the advantages of the finish disclosed in U.S. Pat. No. 3,781,202 in addition to the following advantages over the prior (including that in U.S. Pat. No. 3,781,202) high temperature spin finishes for textile yarn.

lower yarn to metal friction
higher yarn to yarn friction
low number of components
low cost
better yarn package formation
better yarn package unwind properties The combination of low yarn to metal and high yarn to yarn friction is particularly important and can be achieved only by the particular combination and ratio of components listed above, without losing other equally important benefits. The better yarn package formation during take-up of the yarn from spinning is also important. Of course, the low number of components and cost is always important. Higher yarn to yarn friction is conducive to better cohesion in the package as it is taken up and in the yarn as it is processed. For example, this improved cohesion improves tuftability when the yarn is tufted into a carpet.

The friction characteristics are also influenced by the emulsifier. Other compounds than those listed adversely affect the unique lubrication properties of this finish.

The amount of finish used on the yarn is set forth in U.S. Pat. No. 3,781,202.

By tridecyl stearate is meant the pure compound or the compound prepared by reacting tridecyl alcohol with commercial stearic acid, which may also contain some palmitic acid.

DESCRIPTION OF THE PREFERRED EMBODIMENTS

The oil portion of the oil in water emulsion, 4 to 20 percent by weight oil, of this improved spin finish for textured carpet yarn is preferably

I

| Component | Percent by Weight |
|---|---|
| tridecyl stearate | 55 |
| corn oil ethoxylated with 10 mols ethyleneoxide | 22 |
| sulfated glycerol trioleate | 23 |

or

II

| | |
|---|---|
| tridecyl stearate | 50 |
| polyethylene glycol (10) oleate | 23 |
| sulfonated petroleum product | 27 |

By polyethylene glycol (10) oleate is meant 10 mols of polyethylene glycol was reacted with 1 mol oleic acid.

TABLE A

Comparison of Friction and Package Formation

Yarn finish I is labeled I above.

Yarn finish II is labeled II above.

Yarn finish III is shown in Table I of U.S. Pat. No. 3,781,202 and represents the prior art finish and control for these runs.

| Run No. | Yarn Finish | Package Formation Rating | Yarn to Metal | Yarn to Yarn Slip | Yarn to Yarn Stick |
|---|---|---|---|---|---|
| 1 | I | 2.2 | 390 | 370 | 550 |
| 1 | II | 1.5 | 340 | 380 | 800 |
| 1 | III | 0.5 | 410 | 380 | 490 |
| 2 | I | | 75 | 440 | 610 |
| 2 | II | | 65 | 530 | 1130 |
| 2 | III | | 90 | 430 | 640 |
| 3 | I | | 48 | 540 | 790 |
| 3 | II | | 49 | 520 | 1010 |
| 3 | III | | 60 | 480 | 690 |

Run No. 1 was spinning of a 2600 denier, continuous filament yarn which was draw wound and then textured.

Run 2 was spinning of a 1300 denier, continuous filament yarn which was draw-textured in one operation.

Run No. 3 was spinning of a 2600 denier continuous filament yarn, also draw-textured in one operation.

The yarn to metal friction test is described in ASTMD 3108-72T, with results reported here in grams rather than coefficient of friction. The yarn to yarn friction tests were made by simply modifying the yarn to metal test by removing the metal pin and twisting the yarn upon itself 360° in the same location. While running this test, friction builds up as the yarn "sticks" then breaks loose as the yarn "slips." The values reported herein as "stick" and "slip" are the maximum and minimum values obtained for the "stick" and "slip" portions of the test.

The package formation rating is an objective visual rating by experts of the package formed - higher number means better package.

Each rating is an average from 20 packages. The ratings are as follows:

0 — sluffing off end
1 — severe bulge on sides
2 — slight bulge on sides
3 — straight sides, no bulge These results clearly show the highly improved package formation and friction properties of the improved finish of this invention.

The following table shows the criticality of the particular emulsifier-antistatic agent combinations of this invention to the improved friction, static and other properties of the finish of this invention.

TABLE B

| Ingredient | Finish A | Finish II | Finish B | Finish C |
|---|---|---|---|---|
| | Percent by Weight | | | |
| tridecyl stearate | 50 | 50 | 50 | 50 |
| sulfonated petroleum product | 30 | 27 | 30 | 35 |
| corn oil glyceride ethoxylated with 10 mols ethylene oxide | 20 | | | |
| polyethylene glycol (10) | | 23 | | |

TABLE B-continued

| Ingredient | Finish A | Finish II | Finish B | Finish C |
|---|---|---|---|---|
| | Percent by Weight | | | |
| oleate | | | | |
| oleic acid ethoxylated with 5 mols e. o. | | | 20 | 15 |
| static, millivolts | 55 | 25 | 48 | 70 |
| yarn to metal friction, grams | 420 | 390 | 360 | 390 |
| yarn to yarn friction, grams | | | | |
| slip | 643 | 635 | 705 | 785 |
| stick | 953 | 1133 | 1195 | 1310 |
| oil on yarn, % by weight, based on yarn weight | 1.0 | 0.9 | 0.9 | 0.9 |

The static property of the yarn finishes is measured by using a Valchem Friction Analyzer which is similar to the apparatus of the yarn to metal test described in ASTM 3108-72T. In place of the strain gages an eye through a pair of copper electrodes utilizes the Farraday cage principle to detect the amount of static generated across a metal pin. The Farraday "eye" is located just downstream from the pin over which the yarn coated with finish passes traveling at 200 feet per minute. The static is measured with an electrometer, amplified and recorded in millivolts.

As can be seen above, tridecyl stearate with the emulsifier and antistatic agents switched from Finish I and Finish II, i.e., Finish A above, has high yarn to metal friction and poorer static property. Using other emulsifiers gave poorer static properties, also.

Table C, below, shows the processing results of the finishes of this invention, I and II, compared with other finishes; note, that only finishes I and II combine retention of finish after jet texturing, low yarn to metal friction, good package formation, good tufting (into carpet) performance and excellent texturing performance. Each of the other finishes is deficient in one or more of these properties, even though the componenets are similar.

Sulfonated petroleum product is define in U.S. Pat. No. 3,781,202.

TABLE C

| | Finish Compositions | | | | | | |
|---|---|---|---|---|---|---|---|
| | I | II | D | E | F | III[1] | |
| Refined coconut oil | | | 63 | | | 59 | Lubricant |
| tridecyl stearate | 55 | 50 | | | | | Lubricant |
| isodecyl stearate | | | | 63 | | | Lubricant |
| butyl stearate | | | | | 50 | | Lubricant |
| polyethylene glycol (10) oleate | | 23 | | | | | Emulsifier |
| polyethylene glycol (10) corn oil | 20 | | | | | | Emulsifier |
| sulfated petroleum product | | 27 | 12 | 12 | | 10 | Antistat |
| sulfated glycerol triolate | 25 | | | | | | Antistat |
| sorbitol oleate + 40 ethylene oxide | | | 25 | | | | Emulsifier |
| polyethylene glycol oleate | | | | 25 | | | Emulsifier |
| sorbitan oleate | | | | | 25 | | Emulsifier |
| tallow amine + 20 ethylene oxide | | | | | 25 | | Antistat |

| Fiber Processing Data | Finish Compositions | | | | | |
|---|---|---|---|---|---|---|
| | I | II | D | E | F | III |
| % finish on undrawn yarn | .80 | .85 | .85 | .80 | .95 | .78 |
| % finish after jet draw-texture | .75 | .81 | .85 | .50 | .44 | .77 |
| Package formation[4] | 2.2 | 2.0 | 1.5 | 1.3 | 2.4 | .5 |
| Yarn to Metal friction textured yarn in grams | 75 | 65 | 90 | 50 | 60 | 90 |
| Texturizing performance[2] | E | E | F | P | P | G |
| Tufting | G | G | F | F | P | G |

TABLE C-continued

| | Finish Compositions | | | | | |
|---|---|---|---|---|---|---|
| | I | II | D | E | F | III[1] |
| performance[3] | | | | | | |

[1]III is spin finish described in U.S. Pat. No. 3,781,202, Table I.
[2]draw-steam jet textured at 5000 fpm
[3]tufting performance per 50 yards carpet, 180 ends on 30" slat type tufting machine 5/32" gauge
G = good — less than 25 pull backs & 15 snags
F = fair — less than 50 pull backs & 30 snags
P = poor — more than 50 pull backs & 30 snags
[4]package formation — average rating 20 packages
0 = sluffing off end
1 = severe bulge on sides
2 = slight bulge on sides
3 = straight sides — no bulge

We claim:

1. A spin finish for polyamide yarn to be processed at high temperature, said finish being an oil in water emulsion of about 4 to 20 percent by weight of said oil portion, said oil portion consisting essentially of
   a. tridecyl stearate in an amount of from about 40 to 60 percent by weight,
   b. polyethylene glycol (10) oleate in an amount of from about 20 to 30 percent by weight, and
   c. sulfonated petroleum product in an amount of from about 20 to 30 percent by weight.

2. A spin finish for polyamide yarn to be processed at high temperature, said finish being an oil in water emulsion of about 4 to 20 percent by weight of said oil portion, said oil portion consisting essentially of
   a. tridecyl stearate in an amount of from about 40 to 60 percent by weight,
   b. corn oil glyceride ethoxylated with 10 mols ethylene oxide in an amount of from about 20 to 30 percent by weight, and
   c. sulfated glycerol trioleate in an amount of from about 20 to 30 percent by weight.

* * * * *